US005392714A

United States Patent [19]

Bilgeri

[11] Patent Number: 5,392,714

[45] Date of Patent: Feb. 28, 1995

[54] SUB-CALIBRE PROJECTILE WITH SABOT

[75] Inventor: Elmar Bilgeri, Steyr, Austria

[73] Assignee: Steyr-Daimler-Puch AG, Vienna, Austria

[21] Appl. No.: 182,048

[22] PCT Filed: Jul. 15, 1992

[86] PCT No.: PCT/AT92/00097

§ 371 Date: Jan. 18, 1994

§ 102(e) Date: Jan. 18, 1994

[87] PCT Pub. No.: WO93/02333

PCT Pub. Date: Feb. 4, 1993

[30] Foreign Application Priority Data

Jul. 17, 1991 [AT] Austria ..... 1435/91

[51] Int. Cl.[6] ..... F42B 14/06

[52] U.S. Cl. ..... 102/522

[58] Field of Search ..... 102/520–523

[56] References Cited

U.S. PATENT DOCUMENTS 2,306,140 9/1940 Reed ..... 102/522
4,408,538 11/1983 Deffayet et al. ..... 102/522
4,476,785 10/1984 Hoffman et al. ..... 102/522
4,590,862 5/1986 Grabarek et al. ..... 102/522
4,709,638 12/1987 Broden et al. ..... 102/522
5,052,305 10/1991 Chiarelli et al. ..... 102/522

FOREIGN PATENT DOCUMENTS 2401399 3/1979 France .
704406 2/1941 Germany .
2718557 12/1987 Germany .

*Primary Examiner*—Harold J. Tudor
*Attorney, Agent, or Firm*—Meltzer, Lippe, Goldstein et al.

[57] ABSTRACT

Described is a sub-calibre projectile of the sabot (pusher-plate) type with discarding cap segments (11). The projectile has a pressure plate (15) with a rearwards-projecting alignment spike (16) which is inserted into a pressure piece (18). Held between the pressure plate (15) and the pressure piece (18) are the bases (24, 25) of the cap segments (11), thus enabling very high gas-pressure forces to be transmitted and the cap segments to be discarded without affecting the target accuracy of the projectile.

5 Claims, 3 Drawing Sheets

SUB-CALIBRE PROJECTILE WITH SABOT

Figure 1:
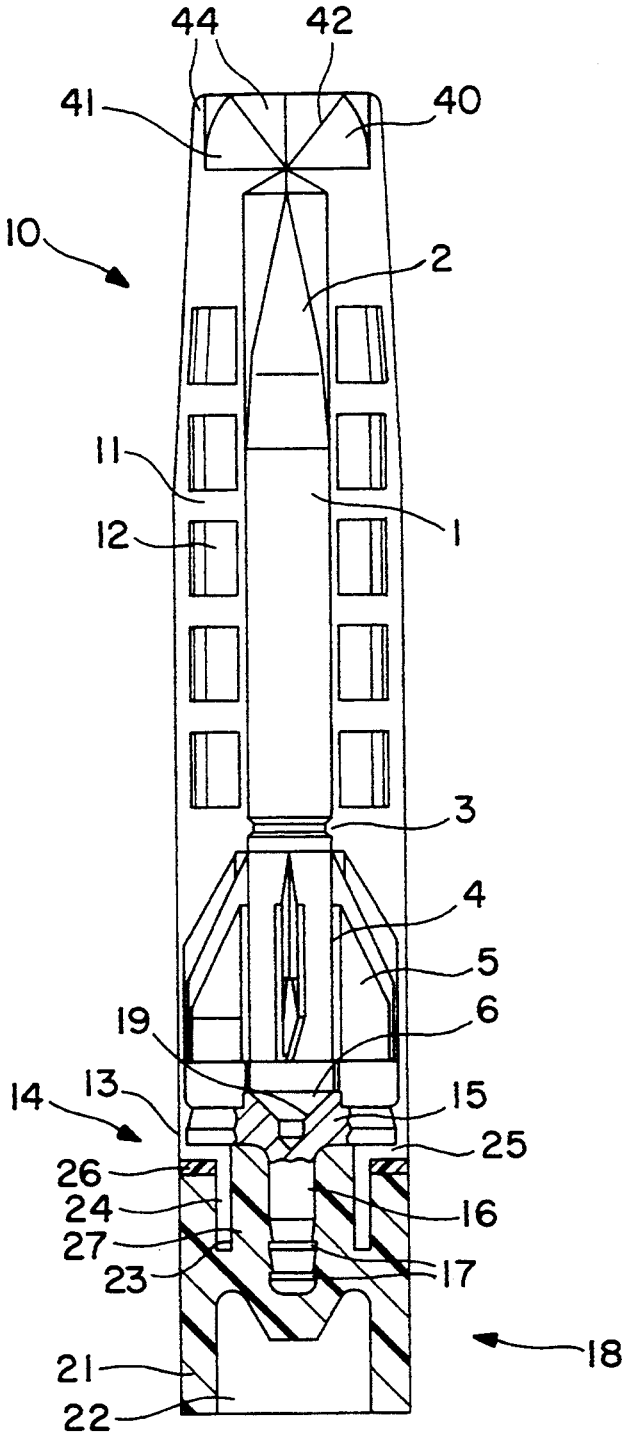

The invention relates to sub-calibre projectiles comprising a core projectile, whose rear end is engaged by pusher means, and a discarding cage, the pusher means consisting of a pressure plate with a rearwards-projecting alignment spike and of a pressure piece into which is inserted the alignment spike. Such projectiles can attain very high initial velocities and consequently a wide service range. This, however, makes target accuracy all the more important and special measures are required to safeguard against the pusher means or the cage discarded after leaving the barrel adversely affecting the projectile.

Such a projectile is known from DE-C 704 406. It consists of a pusher means with a rear extension protruding into parts acted on by gas pressure. A shell case is pressed into a lateral circumferential slot of the pusher means, the shell case being torn apart after leaving the barrel by the centrifugal force acting on expansion rings which are fitted inside the shell case. By this, tearing apart of the shell is neither predictable nor symmetric. Adverse effects on the projectile, which is even self-stabilizing, can thus be expected.

From the DE-C 27 18 557 a pusher means is known, which consists of a block attacked by the gas forces, in front of which is disposed a centered bearing plate holding the projectile as well as the segments of the cage. The latter are designed so as to separate after leaving the barrel by centrifugal force due to rifling of the barrel. They could also be torn apart by aerodynamic forces acting on conical surfaces on the front end of the segments.

This has the disadvantage that block and bearing plate are too short and are only centered with regard to lateral disalignment —which is impossible inside the barrel at any rate—so that these parts tend to tilt under the action of the pressurized gaz and this tilting movement is communicated to the projectile. It is an other disadvantage that the segments of the cage are held together together with the projectile. By this, separation of the segments also affects the projectile adversely with respect to target accuracy. A further disadvantage is the expensive construction of the pusher means and particularly of the segments. Furthermore, in case of a wing-stabilized projectile, there would be a risk of injuring the wings.

It is therefore the object of the invention to propose a cheap and simple projectile of the above kind, which is able to attain highest initial velocity and target accuracy. To this end, according to the invention, the cage consists of individual segments, and the bases of the segments are secured between pressure plate and pressure piece and are linked to the segments at the level of the pressure plate by webs which constitute breaking points.

The segmentation safeguards simultaneous disintegration of the cage. Holding the bases between pressure piece and pressure plate safeguards that the projectile is not adversely affected by the discarding segments. By holding the bases between pressure piece and pressure plate, the segments need not even be united with each other. The breaking points between the segments and their bases safeguard that the segments tilt away simultaneously, do not affect the projectile and do not damage the stabilizing-wings. Altogether this results in easily manufactured and assembled parts and low production cost.

It is advantageous if the alignment spike presents grooves with a barbed cross-section. These provide a firm connection between pressure plate and pressure. Piece, the spike being pressed into the latter so as to provide a fast hold for the bases of the segments of the cage.

In one embodiment of the invention, the pressure piece is made of a plastic material and the bases of the cage are provided with collars inserted into a cylindrical slot of the pressure piece. This embodiment is particularly cheap and the pressure piece with a pusher cavity assures good sealing. The cylindric collar provides for good fastening of the bases in spite of the weakness of the plastic material and for easy dye-casting of the pressure piece in a simple mold.

In another embodiment of the invention, the pressure piece consists of a plurality of disks stacked to form a compact cylinder and the bases of the cage are flanges held by an indented disk. In this way, the pressure piece withstands very high pressures, yet the desirable sealing qualities can be achieved thanks to the stack of disks. It is therefore also sufficient to secure the bases against being pulled out in radial direction by means of the indented disk.

According to a further feature of the invention, a mounting ring is provided between the bases of the segments and the pressure piece. This mounting ring considerably facilitates assembly in case the segments are not linked to each other. In the second embodiment it can be the very indented disk.

In the following, the invention will be described with regard to two preferred embodiments:

FIG. 1: Longitudinal section through a projectile according to the invention in a first embodiment, FIG. 2: Longitudinal section through a projectile according to the invention in a second embodiment, FIG. 3: Projectile according to the invention during disintegration of the cage.

Figure 2:
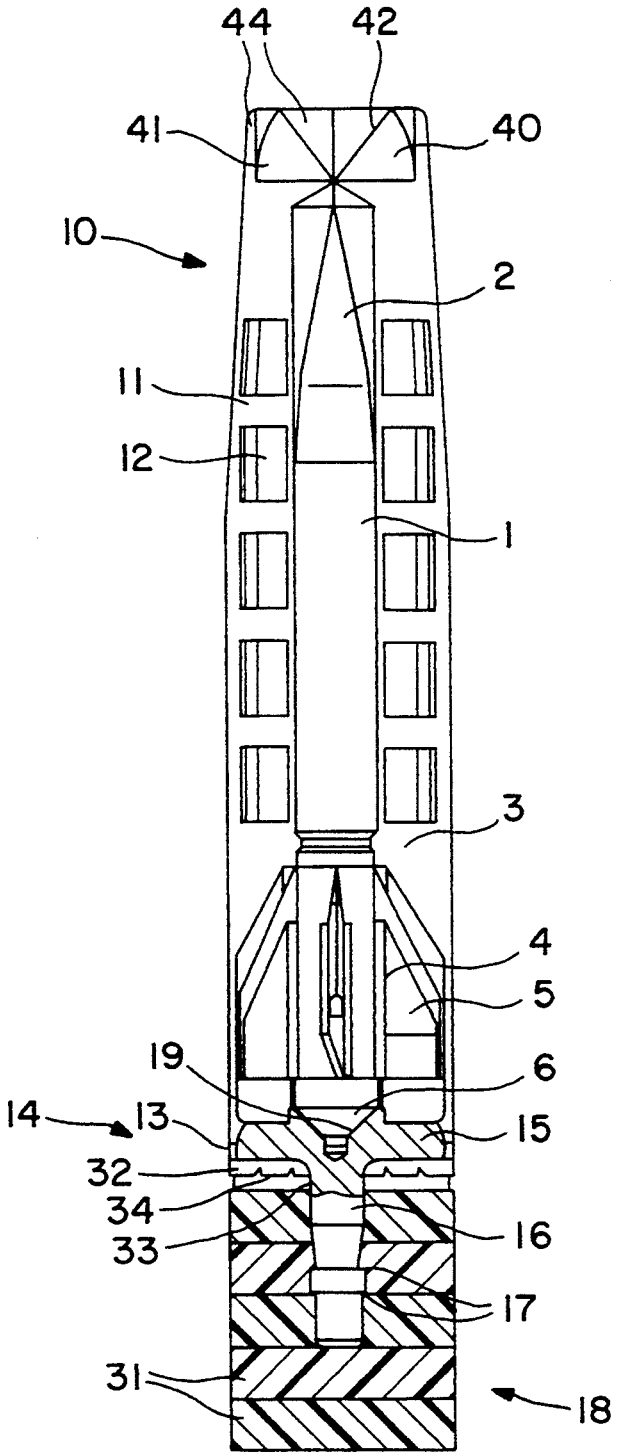

In FIGS. 1 and 2, the projectile core of an arrow-projectile is designated with reference number 1 and it presents a tip 2, a circumferential recess 3 for positioning, a cylindrical part 4 for holding stabilizing wings 5 and a conical rear end 6. The projectile could also be of the spin stabilized type or just a projectile without wings.

The projectile 1 is surrounded by a cage 10 made from a suitable plastic material and consisting of segments 11, which can be either linked to each other or not and which can be provided with perforations or other shapes, immaterial to the invention. The segments 11 are linked to bases 14 by webs 13 which constitute breaking points, the bases 14 being held between a pressure plate 15 from high-tensile steel or titanium and a pressure piece 18 in a manner yet to be described.

The pressure plate 15 is provided on its front side with a conical recess 19 for receiving the conical rear end 6 of the core projectile and on its rear side with an alignment spike 16 with circumferential grooves 17 of a barbed profile. The pressure plate 15 is surrounded on its outer circumference by walls of the segments 11, very thin in the described embodiments in order to accomodate the stabilizing wings 5. Embodiments without such wings are also within the scope of the invention.

The front parts of the segments 11 extend beyond the tip 2 of the projectile, which they enclose between them. Furthermore, the front parts of the individual segments are provided with deflecting surfaces 40,41 and a cylindrical wall 44 whose shape considerably improves separation of the segments 11 after the projectile has left the barrel.

In the embodiments depicted in FIG. 1, the pressure piece 18 is made from a suitable plastic material and comprises a circumferential wall 21 whose lower part creates a pusher cavity 22. Its upper part is provided with a cylindrical slot 23 for fastening the bases 14 of the segments 11. In the described embodiments, the segments are individual, but the cage could also be an integral part with breaking points. The segments 11 pass into a web 13 and further into a radially extending flange 25, followed by a collar 24, which is inserted into the cylindrical slot 23. The circumferential wall 21 is shortened on top in order to leave free space for the flange parts and for the mounting ring 26. The alignment spike 16 of the pressure plate 15 is pressed into the central part 27 of the pressure piece 18, thereby firmly holding the bases 14 between pressure plate 15 and pressure piece 18. In order to improve this hold, the alignment spike 16 is provided with circumferential grooves 17 with barbed profile which facilitate pressing the spike into a bore of the central part 27 but impede pulling the spike out.

The plastic material for the pressure piece 18 is chosen so as to allow for a slight expansion of the circumferential wall 21 under the effect of the gas pressure exerted in the pusher cavity for improved sealing with regard to the barrel and yet to slide with low friction.

The mounting ring 26 facilitates assembly of the projectile in case it consists of individual segments: The individual segments are posed on the pressure plate 15 arond the projectile core seated on the pressure plate and thereafter the mounting ring is slipped onto the segments. In this way, the individual segments are held until the pressure piece 18 is pressed unto the alignment spike 16 and so holds the segments in this way.

In the embodiment according to FIG. 2, the pressure piece 18 consists of individual disks 31 from a suitable plastic material firmly joined to one another by ultrasonic or friction welding and so being a solid block with the desired properies with respect to sealing, low friction and strength. The alignment spike 16 of the pressure plate 15 is again pressed into this block. A further difference with the embodiment of FIG. 1 resides in the bases 14 of the segments 11 being only flanges 32, followed by a disk 33 with indentations 34. The disk in this embodiment suffices for holding the flange parts 32 and also acts as a mounting ring, as described above.

Figure 3:
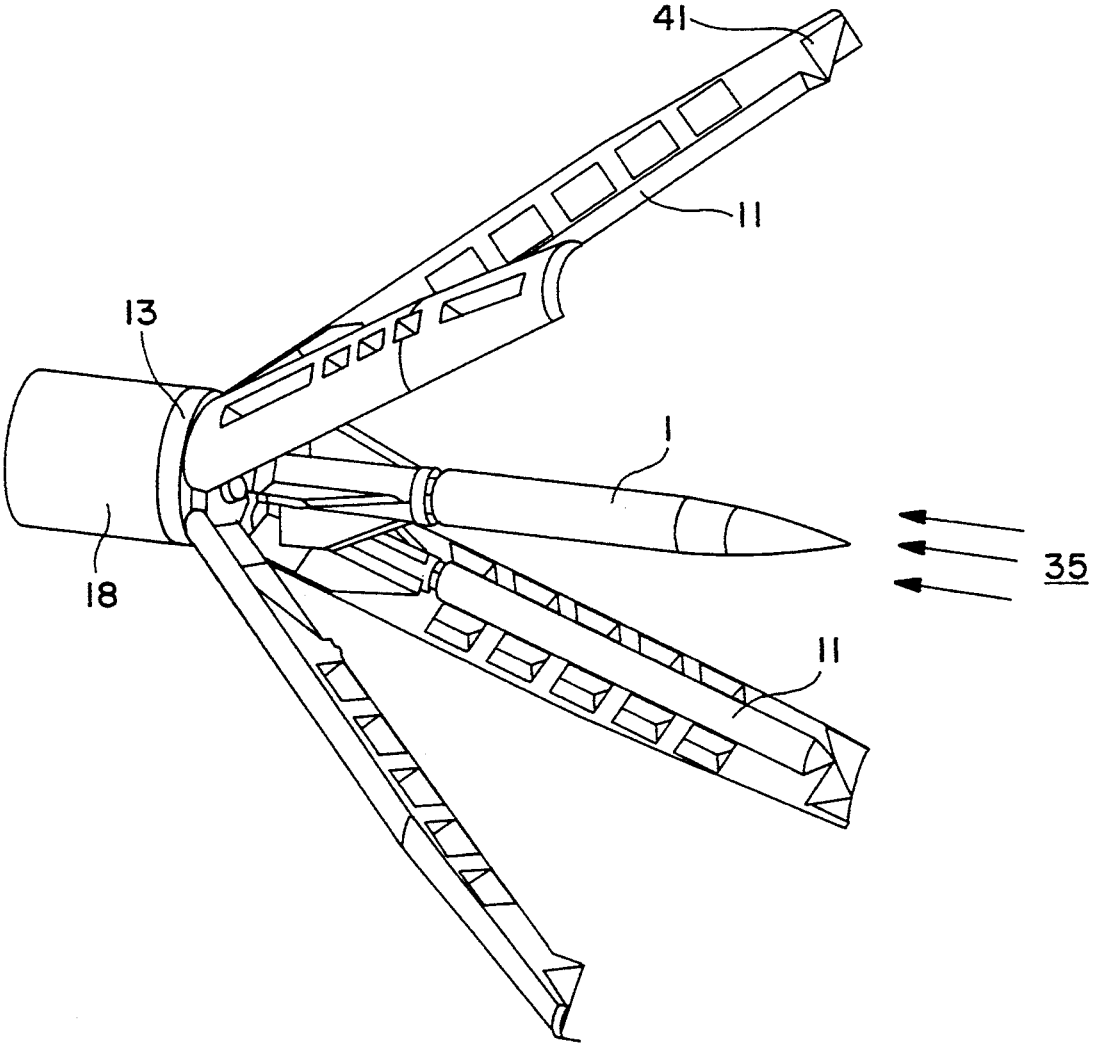

FIG. 3 shows the disintegrating cage for both embodiment of the invention after leaving the barrel. By the effect of the air flow 35, the segments are forced apart. It can be seen that both (in this case) four segments are tilted away from the axis of the projectile by the same angle and therefore rupture at the breaking points occurs simultaneously. By the braking effect, the speed of the segments diminishes so much before rupture at the breaking points, that the pushing means and segments stay behind the core projectile without even touching it.

I claim:

1. Sub-calibre projectile comprising a core projectile, whose rear end is acted on by pusher means, and a discarding cage, the pusher means comprising a pressure plate (15) with a rearward projecting alignment spike (16) and a pressure piece (18) into which is inserted the alignment spike (16), characterised in that the cage (10) comprises individual segments (11) and in that bases (14) of the segments (11) are secured between pressure plate (15) and pressure piece (18) and are linked to the segments (11) at the level of the pressure plate (15) by webs (13) which constitute breaking points.

2. Sub-calibre projectile according to claim 1, characterised in that the alignment spike (16) presents grooves (17) with a barbed cross-section.

3. Sub-calibre projectile according to claim 1, characterised in that the pressure piece (18) is made of a plastic material and in that the bases (14) of the cage (10) are provided with collars (24) inserted into a cylindrical slot (23) of the pressure piece (18).

4. Sub-calibre projectile according to claim 1, characterised in that the pressure piece (18) comprises of a plurality of disks (31) stacked to form a compact cylinder and in that the bases (14) of the cage (10) are flanges (32) held by an indented disk (33).

5. Sub-calibre projectile according to claim 1, characterised in that a mounting ring (26,33) is provided between the bases (14) of the segments and the pressure piece (18).

* * * * *